US008008247B2

(12) United States Patent
Falk et al.

(10) Patent No.: US 8,008,247 B2
(45) Date of Patent: Aug. 30, 2011

(54) TUMBLE DRYER BLEACH AND FABRIC TREATMENT

(75) Inventors: Nancy Ann Falk, Livermore, CA (US); Ricardo J. Leon, Miami, FL (US); William L. Smith, Pleasanton, CA (US); Gregory van Buskirk, Danville, CA (US)

(73) Assignee: The Clorox Company, Oakland, CA (US)

( * ) Notice: Subject to any disclaimer, the term of this patent is extended or adjusted under 35 U.S.C. 154(b) by 474 days.

(21) Appl. No.: 12/141,815

(22) Filed: Jun. 18, 2008

(65) Prior Publication Data

US 2009/0313766 A1 Dec. 24, 2009

(51) Int. Cl.
*C11D 3/395* (2006.01)

(52) U.S. Cl. ..... 510/519; 510/281; 510/295; 510/297; 510/302; 510/367; 510/379

(58) Field of Classification Search ..... 510/519, 510/281, 295, 297, 302, 367, 379
See application file for complete search history.

(56) References Cited

U.S. PATENT DOCUMENTS

| | | | | | |
|---|---|---|---|---|---|
| 3,945,936 | A | * | 3/1976 | Lucas et al. | 252/186.2 |
| 3,989,638 | A | * | 11/1976 | Bradley et al. | 252/186.25 |
| 4,011,172 | A | * | 3/1977 | Marsan et al. | 206/0.5 |
| 4,130,392 | A | * | 12/1978 | Diehl et al. | 8/101 |
| 4,243,391 | A | | 1/1981 | Puchta et al. | |
| 4,273,661 | A | | 6/1981 | Grey | |
| 4,286,016 | A | * | 8/1981 | Dimond et al. | 206/0.5 |
| 4,348,293 | A | | 9/1982 | Clarke et al. | |
| 4,374,035 | A | | 2/1983 | Bossu | |
| 4,374,747 | A | | 2/1983 | Tai | |
| 4,391,273 | A | | 7/1983 | Chiquiar-Arias | |
| 4,391,724 | A | | 7/1983 | Bacon | |
| 4,391,725 | A | | 7/1983 | Bossu | |
| 4,395,261 | A | * | 7/1983 | Lutz | 8/111 |
| 4,473,507 | A | * | 9/1984 | Bossu | 562/2 |
| 4,513,459 | A | | 4/1985 | Doughty | |
| 4,515,703 | A | | 5/1985 | Haq | |
| 4,557,852 | A | | 12/1985 | Schulz et al. | |
| 4,613,332 | A | | 9/1986 | Casella et al. | |
| 4,740,213 | A | | 4/1988 | Ricci | |
| 4,776,455 | A | * | 10/1988 | Anderson et al. | 206/0.5 |
| 4,818,422 | A | * | 4/1989 | Adams et al. | 510/297 |
| 4,889,643 | A | * | 12/1989 | Royce et al. | 510/297 |
| 4,925,586 | A | * | 5/1990 | Baker et al. | 510/297 |
| 5,002,679 | A | | 3/1991 | Tai | |
| 5,002,681 | A | * | 3/1991 | Wierenga et al. | 510/297 |
| RE33,646 | E | | 7/1991 | Klemm et al. | |
| 5,053,270 | A | | 10/1991 | Mack | |
| 5,077,119 | A | | 12/1991 | Wraige | |
| 6,040,286 | A | | 3/2000 | Huff | |
| 6,759,006 | B1 | | 7/2004 | Siklosi et al. | |
| 6,995,122 | B2 | | 2/2006 | Popplewell et al. | |
| 2002/0006887 | A1 | | 1/2002 | Radwanski et al. | |
| 2002/0055449 | A1 | * | 5/2002 | Porta et al. | 510/295 |
| 2004/0167056 | A1 | | 8/2004 | Lentsch et al. | |
| 2005/0250184 | A1 | | 11/2005 | Sheppard et al. | |
| 2007/0173423 | A1 | * | 7/2007 | Vermeer et al. | 510/101 |
| 2008/0166176 | A1 | * | 7/2008 | Rees et al. | 401/196 |

FOREIGN PATENT DOCUMENTS

| | | |
|---|---|---|
| WO | WO 85/05120 | 11/1985 |
| WO | WO 90/02166 | 3/1990 |
| WO | WO 2005/026432 | 3/2005 |
| WO | WO 2005/035708 | 4/2005 |

* cited by examiner

*Primary Examiner* — Charles Boyer
(74) *Attorney, Agent, or Firm* — Alok Goel; Stacy H. Combs

(57) ABSTRACT

The invention relates to a treatment article and a method for treating a fabric by delivering one or more powdered benefit agents to a fabric in a tumble dryer and thus providing at least one fabric benefit such as sanitization and/or disinfection, whitening and/or stain removal to the fabric during the tumble drying process. The treatment article functions to dispense at least one powdered benefit agent to the fabric by means of a diffusing membrane having an average pore diameter such that the tumbling and/or heating action provided during the tumble drying process results in the delivery of an oxidant material in the form of a powdered benefit agent to the initially damp or wet fabric to provide at least one primary fabric benefit to the treated fabric. Optionally, a second and/or third benefit agent may additionally be included in the treatment article for simultaneous delivery of one or more additional fabric benefits. The invention also relates to a treatment kit employing a treatment article with instructions for the effective delivery of one or more fabric benefits to a fabric during a tumble drying process.

18 Claims, 5 Drawing Sheets

TUMBLE DRYER BLEACH AND FABRIC TREATMENT

BACKGROUND OF THE INVENTION

1. Field of the Invention

This invention relates generally to treatment articles, methods and kits for the treatment of clothing, textiles and other fabric based materials in a tumble drying machine to effect improved cleaning, sanitization, disinfection and/or delivery of fabric care beneficients to such materials during an automatic tumble dry process.

Generally, treatment of clothing and textiles to remove odors, stains, soils and to effect sanitization and/or disinfection, as well as to deliver fabric beneficients is achieved during the wash process, being done by hand or modernly by use of an automatic washing machine. Detergents, cleaners, laundry additives, bleaches, and fabric treatments and fabric softening compositions in one form or another are typically added or introduced into either or both the washing and/or rinse liquor of an automatic washing either manually by the user or automatically at a provident time during the wash process for maximum effectiveness. Despite a veritable explosion in the number of technologies relating to cleaning, bleaching and sanitizing of laundry and similar advances in washing machine technology, it is not uncommon for clothes to harbor stubborn stains and residues despite being washed, and otherwise exhibit other degradations to their appearance, integrity, feel, odor and durability as a result of the wash process. It is well known in the art that some soils and stains, particularly those resulting from food residues, biological materials and organisms such bacteria, viruses, molds and mildews can persist on fabrics even through the wash cycle. Further, some soils and stains can become 'heat-set' if their residue remains on the fabric which is then subject to heated drying that occurs in a tumble dryer.

Accordingly, a need exists for a convenient and reliable means to further treat a fabric item following a washing step when the fabric is still wet or damp and is to be subsequently dried using a tumble dryer machine, in order to effect further stain or soil removal, sanitize, disinfect, sterilize and/or otherwise provide an additional fabric benefit to the fabric that was not achieved during a prior washing step.

The treatment article of the present invention is drawn to a pouch constructed of a diffusing membrane in the form of a flexible hollow containment means that initially holds and then dispenses at least one powdered benefit agent being an oxidant material in substantially powder form to the fabric within a tumble dryer in order to deliver at least one primary fabric benefit selected from a bleaching benefit, whitening benefit, stain removal benefit, odor removal benefit, mildew removal benefit, decontamination benefit, sanitization benefit, disinfection benefit, sterilization benefit, and/or combinations thereof. The treatment article optionally includes additional powdered benefit agents that may either be dispensed or which act to release additional fabric beneficients. The invention is further drawn to a means of using a barrier coating on the treatment article to prevent premature release and/or control the release of powdered benefit agents. The invention is also drawn to methods of use and a treatment kit employing a treatment article for the effective delivery of one or more fabric benefit agents providing one or more fabric benefits to a fabric during a tumble drying process.

2. Description of the Related Art

It is well known in the art that at elevated temperatures hydrogen peroxide is very useful for providing color safe bleaching benefits to fabrics. It is normally not practical to bleach with hydrogen peroxide at temperatures below about 70° C. (140° F.) to achieve the optimum sanitization and/or bleaching effect. The temperature and humidity conditions (low water to fabric ratio) found during the drying process in a clothes dryer are ideal for achieving optimum performance of this type of bleach.

Lutz in U.S. Pat. No. 4,395,261 teaches a method for bleaching damp fabrics while they are exposed to heated gases in a clothes dryer by means of hydrogen peroxide.

The hydrogen peroxide is initially confined as a liquid in a container, with a hydrophobic membrane. The heat of the dryer vaporizes the hydrogen peroxide, which allows it to pass through the membrane and be delivered to the fabric from the vapor phase. They claim the ideal time to achieve the best performance to do this is when the fabrics are still damp, yet near the end of the drying cycle when the temperature within the dryer is the highest. However, it is not specified on how best (either by device and/or process) this can be done.

In U.S. Pat. Nos. 3,989,638 and 4,017,411, thickened hydrogen peroxide solutions are dispensed as a liquid from a porous pouch onto the surface of the textiles through the tumbling action within the clothes dryer. This method has two disadvantages: first, it has a tendency to distribute the hydrogen peroxide unevenly over the textiles; and second, it distributes most of the hydrogen peroxide onto the textiles at an early stage in the drying process, before the temperature of the dryer reaches the high temperature required for bleaching with hydrogen peroxide or other peroxygen bleaches.

Alternatively, U.S. Pat. No. 4,130,392 tumbles the fabrics in the clothes dryer with a solid peroxygen activator, 1,3,4,6-tetra-acetyl glycouril, plus a solid particulate bleaching compound, such as sodium perborate or sodium percarbonate. This process has the obvious disadvantage of requiring the addition of undesirable solid particles to the clean fabrics in the dryer and can result in the buildup of such materials within the dryer or on the lint filter of the dryer. Further, such a process is even more prone to result in uneven bleaching of the textiles because of the solid particles.

SUMMARY OF THE INVENTION

In accordance with the above objects and those that will be mentioned and will become apparent below, one aspect of the present invention is a treatment article for treating a fabric during a tumble drying process to deliver at least one benefit agent to the fabric, said treatment article comprising (a) at least one pouch which dispenses at least one powdered benefit agent during at least one drying cycle, said pouch comprising: (i) a flexible hollow containment means comprising a diffusing membrane separating and totally surrounding an interior region from an outer exterior environment; wherein said containment means has an interior volume capable of containing from between 1 to 100 grams of at least one powdered benefit agent; wherein said diffusing membrane provides the only communication means for migration of the powdered benefit agent between the interior region and the outer exterior environment; wherein said diffusing membrane comprises a porous water insoluble non-woven material having an average pore diameter of 250 microns to 1000 microns, and a thickness of less than 7.5 millimeters; wherein said non-woven material comprises a bleach stable polymer; and (b) a powdered benefit agent comprising an oxidant material in the form of particles having a mean particle size of at least 250 microns; wherein said oxidant material comprises a chlorine-based bleaching agent.

In another aspect of the present invention, the treatment article optionally includes a second benefit agent comprising a secondary benefit material in the form of secondary particles having a mean secondary particle size of between 100 to 1000 microns.

In a further aspect of the present invention, the treatment article optionally includes a third benefit agent comprising a third benefit material in the form of a tertiary particle having an initial mean tertiary particle size value that is at least 2 times greater than the average pore diameter of the diffusing membrane; wherein said third benefit agent undergoes at least one of a phase change, a physical change and/or a chemical change when heated to a temperature above 30° C.; wherein the tertiary benefit agent is capable of being released from the pouch through the diffusing membrane when in the form of a liquid, a gas, a vapor, a volatilized substance and/or combinations thereof.

Yet another aspect of the present invention is a treatment article wherein the exterior facing side of the diffusing membrane used to form the flexible hollow containment means is wholly surrounded by at least one barrier membrane; wherein said barrier membrane is selected from the group consisting of a water degradable membrane or coating, a moisture degradable membrane or coating, a heat degradable membrane or coating, a friction degradable membrane or coating, a manually removable membrane or coating, and/or combinations thereof. In any one aspect of the present invention employing a barrier membrane, the barrier membrane serves to prevent premature release of the one or more powdered benefit agents until such time that water, moisture, heat, friction and/or a manual removal process is brought to bear on the treatment article to effectively degrade the barrier membrane so as to nullify its barrier properties. In one aspect of the present invention employing a barrier membrane, the barrier membrane is degraded during the tumble drying process, preferably during the first ten minutes of the tumble drying process. In another aspect of the present invention employing a barrier membrane, the barrier membrane functions to prevent premature release of the one or more powdered benefit agents from the pouch outside of the tumble dryer, for example during manufacture, handling, storage and/or manipulation by the user prior to placement in the tumble dryer. In another aspect of the present invention employing a barrier membrane, the barrier membrane is in the form of a heat degradable coating that effectively seals the pores on the exterior facing side of the diffusing membrane and which coating degrades with increasing temperature to effect a temperature dependent release of a powdered benefit agent as the heat degradable coating is removed from the pores of the diffusing membrane.

In yet another aspect of the present invention, the treatment article is a pouch constructed using a diffusing membrane to form a flexible hollow containment means made using a bleach stable polymer selected from the group consisting of polyester, polypropylene, polyethylene, hydrophilically modified polyester, hydrophobically modified polyester, hydrophilically modified polypropylene, hydrophilically modified polyethylene and/or mixtures thereof.

In another aspect of the present invention, the chlorine-based bleaching agent employed as an oxidant material in the role of a first powdered benefit agent has a water solubility of at least 25 grams per 100 grams of water at 25° C., or alternatively at least 10 grams per 100 grams of water at 25° C., or yet alternatively at least 1 grams per 100 grams of water at 25° C.

In a further aspect of the present invention, the chlorine-based bleaching agent employed as an oxidant material in the role of a first powdered benefit agent has a mean particle size value of 250 microns to 1000 microns.

In a further aspect of the present invention, the chlorine-based bleaching agent employed as an oxidant material in the role of a first powdered benefit agent is a friable powder which is susceptible to the effects of an externally applied energy being at least one of heat, friction, moisture and/or mechanical tumbling action so as to undergo a reduction in the initial mean particle size to a plurality of particles having a reduced mean particle size that is substantially less than the initial value, so that following a reduction in the mean particle size, the powdered oxidant material becomes capable of passing through the diffusing membrane of the pouch, the initial mean particle size of the powdered benefit agent being sufficient large so that the material is essentially incapable of passing through the diffusing membrane in its initial form.

In an aspect of the present invention employing a friable powder as an oxidant material, the chlorine-based bleaching agent has an initial mean particle size value greater than 250 microns and less than or equal to 2 times the average pore diameter of the diffusing membrane; or alternatively greater than 250 microns and less than or equal to 1.5 times the average pore diameter of the diffusing membrane; or alternatively greater than 250 microns and essentially equal to the average pore diameter of the diffusing membrane.

In another aspect of the present invention, the powdered benefit agent is an oxidant material comprising a chlorine-based bleaching agent selected from the group consisting of hydrated forms of said bleaching agents in a form having one or more molar equivalents of bound water, including for example, but not limited to sodium dichloroisocyanurate dihydrate, hydrated chlorinated trisodium phosphate complex, calcium hypochlorite dihydrate, dibasic calcium hypochlorite dihydrate, and combinations thereof.

In yet another aspect of the present invention, the powdered benefit agents are in the form of a carrier particle releasably containing the oxidant material, wherein the carrier particle has a mean particle size of at least 250 microns.

In one or more aspects of the present invention, the powdered benefit agent provides at least one primary fabric benefit to a treated fabric during the tumble drying process; wherein the primary fabric benefit is selected from a bleaching benefit, whitening benefit, stain removal benefit, odor removal benefit, mildew removal benefit, decontamination benefit, sanitization benefit, disinfection benefit, sterilization benefit, and/or combinations thereof.

In a further aspect of the present invention, a method is provided for treating a fabric during a tumble drying process to deliver at least one powdered benefit agent to the fabric, comprising: (a) placing at least one treatment article in the interior drum of a tumble dryer machine; (b) placing at least one fabric in said drum; wherein said at least one fabric is damp and/or wet with water when placed in said drum; wherein steps (a) and (b) may be performed in any order and/or simultaneously; (c) initiating a drying cycle of said tumble dryer machine sufficient to subject said fabric to heat at a temperature in the range of from about 40° C. to about 100° C. for at least 10 minutes; (d) tumbling said treatment article with said fabric for a time sufficient for at least 75% of a powdered benefit agent to be released from said treatment article in order to contact the fabric to provide at least one fabric benefit effect on the fabric; wherein said time sufficient for at least 75% of said powdered benefit agent to be released is less than or equal to 20 minutes; (e) substantially drying said fabric so that a plurality of the powdered benefit agent particles are effectively detached from said fabric; and (f) allowing said fabric to cool to ambient temperature; whereby a primary fabric benefit has been provided to the fabric, wherein said primary fabric benefit is selected from a bleaching benefit, whitening benefit, stain removal benefit, odor removal benefit, mildew removal benefit, sanitization benefit, disinfection benefit, sterilization benefit, and/or combinations thereof.

In yet another aspect of the present invention, a treatment kit is provided comprising the treatment article of the present invention and instructions for using the treatment kit; wherein the instructions instruct the use of a treatment article with a substantially bleach resistant fabric; and wherein the treatment kit provides at least one fabric benefit to a fabric treated in a tumble drying process according to the method of use of a treatment article of the present invention; wherein said fabric benefit is selected from the group consisting of a bleaching benefit, whitening benefit, stain removal benefit, odor removal benefit, mildew removal benefit, decontamination benefit, sanitization benefit, disinfection benefit, sterilization benefit, and/or combinations thereof.

Further features and advantages of the present invention will become apparent to those of ordinary skill in the art in view of the detailed description of preferred embodiments below, when considered together with the attached drawings and claims. Reference will now be made to the drawings wherein like numerals refer to like parts throughout.

BRIEF DESCRIPTION OF THE DRAWINGS

The foregoing aspects and others will be readily appreciated by the skilled artisan from the following description of illustrative embodiments when read in conjunction with the accompanying drawings.

DETAILED DESCRIPTION

Figure 1:
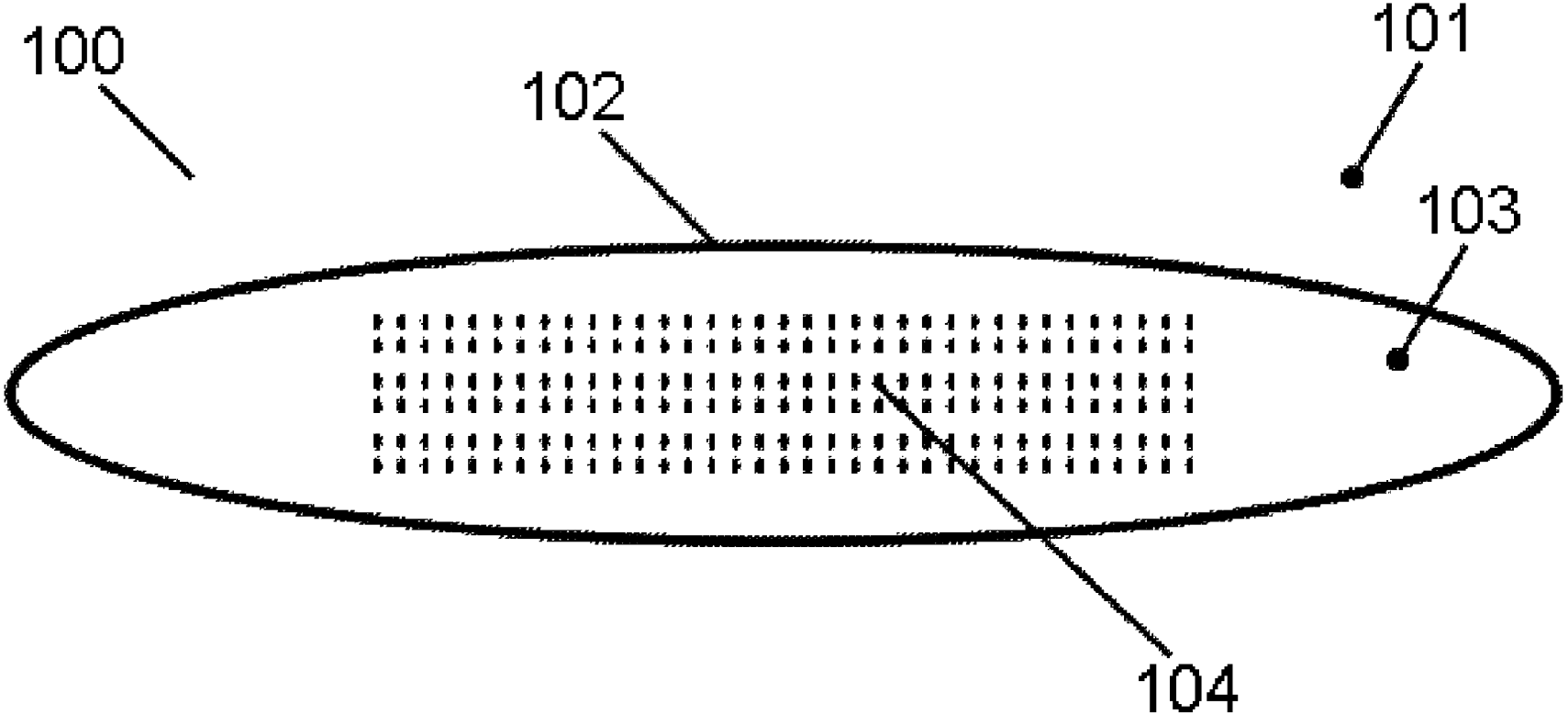
FIG. 1 is an illustration of a treatment article in the form of a pouch (100) with a diffusing membrane (102) forming a containment means by separating an interior region (103) which holds a powdered benefit agent (104) from an exterior environment (101).

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the total composition.

As used herein, the term "fabric" is intended to include any object, article or thing made from or containing at least in part some woven or non-woven fabric portion that may be treated in an automatic dryer cycle. Examples of such a fabric include, but are not limited to, clothing, clothes articles, jackets, coats, ponchos, overcoats, textiles, textile articles, upholstered items, such as cushions, purses, bags, wallets, carrying bags, luggage, satchels, shoes, boots, sneakers, shoe inserts, gloves, hats, and articles coating woven or non-woven portions such as rugs, floor mats, toilet seat covers, carpets, curtains, window shades, window covers, car and vehicle covers, tarpaulins, pet beds, pillows and soft articles, such as stuffed animals, children's toys, blankets, play rugs, mats, exercise mats, and the like. Also included are fabric materials consisting of natural and/or synthetic fibers in the form of hair, fur, fuzzy materials, Velcro hook and loop fastening materials, and soft articles comprising natural and/or synthetic material constructs such as foam, sponge, microspun articles, laminates, and elastomeric items such as diving suites and related diving wear, overcoats, overshoes, protective vests and outerwear such as bullet-proof and sharp-object protective clothing including gloves and vests, and in general any items that can be tumbled in an automatic dryer machine with or without heat being applied without causing damage to such item during the tumbling process.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries. Further, the term "polymer" shall include all possible physical forms of the polymeric material, including fibers, threads, filaments, mats, foams, porous constructs including woven and non-woven membranes, sheets, films and/or laminated structures capable of functioning as a diffusing membrane for the purposes of the present invention.

The term "cleaning composition", as used herein, is meant to mean and include a cleaning formulation having at least one oxidant material.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic, cationic, zwitterionic and/or amphoteric surface active agents and/or tensides and/or hydrotropes capable of surface tension reduction.

Treatment Article

In one embodiment of the invention is a treatment article for treating a fabric during a tumble drying process to deliver at least one benefit agent to the fabric, said treatment article comprising (a) at least one pouch which dispenses at least one powdered benefit agent during at least one drying cycle, said pouch comprising: (i) a flexible hollow containment means comprising a diffusing membrane separating and totally surrounding an interior region from an outer exterior environment; wherein said containment means has an interior volume capable of containing from between 1 to 100 grams of at least one powdered benefit agent; wherein said diffusing membrane provides the only communication means for migration of the powdered benefit agent between the interior region and the outer exterior environment; wherein said diffusing membrane comprises a porous water insoluble non-woven material having an average pore diameter of 250 microns to 1000 microns, and a thickness of less than 7.5 millimeters; wherein said non-woven material comprises a bleach stable polymer; and (b) a powdered benefit agent comprising an oxidant material in the form of particles having a mean particle size of at least 250 microns; wherein said oxidant material comprises a chlorine-based bleaching agent.

In another embodiment of the invention, the treatment article optionally includes a second benefit agent comprising a secondary benefit material in the form of secondary particles having a mean secondary particle size of between 100 to 1000 microns.

In a further embodiment of the invention, the treatment article optionally includes a third benefit agent comprising a third benefit material in the form of a tertiary particle having an initial mean tertiary particle size value that is at least 2 times greater than the average pore diameter of the diffusing membrane; wherein said third benefit agent undergoes at least one of a phase change, a physical change and/or a chemical change when heated to a temperature above 30° C.; wherein the tertiary benefit agent is capable of being released from the pouch through the diffusing membrane when in the form of a liquid, a gas, a vapor, a volatilized substance and/or combinations thereof.

In yet another embodiment of the invention, the exterior facing side of the diffusing membrane used to form the flexible hollow containment means is wholly surrounded by at least one barrier membrane; wherein said barrier membrane is selected from the group consisting of a water degradable membrane or coating, a moisture degradable membrane or coating, a heat degradable membrane or coating, a friction degradable membrane or coating, a manually removable membrane or coating, and/or combinations thereof. In a further embodiment of the invention employing a barrier membrane, the barrier membrane serves to prevent premature release of the one or more powdered benefit agents until such time that water, moisture, heat, friction and/or a manual removal process is brought to bear on the treatment article to effectively degrade the barrier membrane so as to nullify its barrier properties. In another embodiment of the invention, the barrier membrane is degraded during the tumble drying process, preferably during the first ten minutes of the tumble drying process. In yet another embodiment of the present invention, the barrier membrane functions to prevent premature release of the one or more powdered benefit agents from the pouch outside of the tumble dryer, for example during manufacture, handling, storage and/or manipulation by the user prior to placement in the tumble dryer. In yet a further embodiment of the invention, the barrier membrane is in the form of a heat degradable coating that effectively seals the pores on the exterior facing side of the diffusing membrane and which coating degrades with increasing temperature to effect a temperature dependent release of a powdered benefit agent as the heat degradable coating is removed from the pores of the diffusing membrane.

In one embodiment of the invention, the treatment article is a pouch constructed using a diffusing membrane to form a flexible hollow containment means made using a bleach stable polymer selected from the group consisting of polyester, polypropylene, polyethylene, hydrophilically modified polyester, hydrophobically modified polyester, hydrophilically modified polypropylene, hydrophilically modified polyethylene and/or mixtures thereof.

In another embodiment of the invention, the chlorine-based bleaching agent employed as an oxidant material in the role of a first powdered benefit agent has a water solubility of at least 25 grams per 100 grams of water at 25° C., or alternatively at least 10 grams per 100 grams of water at 25° C., or yet alternatively at least 1 grams per 100 grams of water at 25° C.

In a further embodiment of the invention, the chlorine-based bleaching agent employed as an oxidant material in the role of a first powdered benefit agent has a mean particle size value of at least 250 microns, or alternatively of 250 microns to 1000 microns, or alternatively of 250 microns to 500 microns.

In yet a further embodiment of the invention, the chlorine-based bleaching agent employed as an oxidant material in the role of a first powdered benefit agent is a friable powder which is susceptible to the effects of an externally applied energy being at least one of heat, friction, moisture and/or mechanical tumbling action so as to undergo a reduction in the initial mean particle size to a plurality of particles having a reduced mean particle size that is substantially less than the initial value, so that following a reduction in the mean particle size, the powdered oxidant material becomes capable of passing through the diffusing membrane of the pouch, the initial mean particle size of the powdered benefit agent being sufficient large so that the material is essentially incapable of passing through the diffusing membrane in its initial form.

In another embodiment of the invention employing a friable powder as an oxidant material, the chlorine-based bleaching agent has an initial mean particle size value greater than 250 microns and less than or equal to 2 times the average pore diameter of the diffusing membrane; or alternatively greater than 250 microns and less than or equal to 1.5 times the average pore diameter of the diffusing membrane; or alternatively greater than 250 microns and essentially equal to the average pore diameter of the diffusing membrane.

In yet another embodiment of the invention, the powdered benefit agent is an oxidant material comprising a chlorine-based bleaching agent selected from the group consisting of hydrated forms of said bleaching agents in a form having one or more molar equivalents of bound water, including for example, but not limited to sodium dichloroisocyanurate dihydrate, hydrated chlorinated trisodium phosphate complex, calcium hypochlorite dihydrate, dibasic calcium hypochlorite dihydrate, and combinations thereof.

Another embodiment of the invention employs the powdered benefit agents in the form of a carrier particle releasably containing the oxidant material, wherein the carrier particle has a mean particle size value of at least 250 microns, or alternatively of 250 microns to 1000 microns, or alternatively of 250 microns to 500 microns.

A further embodiment of the invention employs a powdered benefit agent providing at least one primary fabric benefit to a treated fabric during the tumble drying process; wherein the primary fabric benefit is selected from a bleaching benefit, whitening benefit, stain removal benefit, odor removal benefit, mildew removal benefit, decontamination benefit, sanitization benefit, disinfection benefit, sterilization benefit, and/or combinations thereof.

In one embodiment of the invention, a method is provided for treating a fabric during a tumble drying process to deliver at least one powdered benefit agent to the fabric, comprising: (a) placing at least one treatment article according to present invention in the interior drum of a tumble dryer machine; (b) placing at least one fabric in said drum; wherein said at least one fabric is damp and/or wet with water when placed in said drum; wherein steps (a) and (b) may be performed in any order and/or simultaneously; (c) initiating a drying cycle of said tumble dryer machine sufficient to subject said fabric to heat at a temperature in the range of from about 40° C. to about 100° C. for at least 10 minutes; (d) tumbling said treatment article with said fabric for a time sufficient for at least 75% of a powdered benefit agent to be released from said treatment article in order to contact the fabric to provide at least one fabric benefit effect on the fabric; wherein said time sufficient for at least 75% of said powdered benefit agent to be released is less than or equal to 20 minutes; (e) substantially drying said fabric so that a plurality of the powdered benefit agent particles are effectively detached from said fabric; and (f) allowing said fabric to cool to ambient temperature; whereby a primary fabric benefit has been provided to the fabric, wherein said primary fabric benefit is selected from a bleaching benefit, whitening benefit, stain removal benefit, odor removal benefit, mildew removal benefit, sanitization benefit, disinfection benefit, sterilization benefit, and/or combinations thereof.

In another embodiment of the invention, a treatment kit is provided comprising the treatment article of the present invention and instructions for using the treatment kit; wherein the instructions instruct the use of a treatment article with a substantially bleach resistant fabric; and wherein the treatment kit provides at least one fabric benefit to a fabric treated in a tumble drying process according to the method of use of a treatment article of the present invention; wherein said fabric benefit is selected from the group consisting of a bleaching benefit, whitening benefit, stain removal benefit, odor removal benefit, mildew removal benefit, decontamination benefit, sanitization benefit, disinfection benefit, sterilization benefit, and/or combinations thereof.

Without being bound by theory, the inventors believe that the powdered bleaches are sufficiently uniformly dispersed by the treatment article of the present invention into the interior of the tumble dryer and onto the fabrics within so as to coat the damp fabrics with a fine layer of the powdered benefit agent, which owing to the small mean particle size distribution of the oxidant material promotes extremely rapidly dissolution of the adhered oxidant particles into nascent water associated with the damp fabric so as to form a thin in-situ layer of bleaching solution in intimate contact with the fabric surface.

Pouch

The treatment article of the present invention may take the form of a pouch, as illustrated in FIG. 1, where the walls of the pouch are constructed using a diffusing membrane (102) material to form a flexible hollow containment means totally surrounding and separating an interior region (103) in which the pouch contents, a powdered benefit agent (104) and any other optional contents, are separated from an outer exterior environment (101). Any suitable means may be employed to form the flexible hollow containment means of the present invention, the only requirement being that the diffusing membrane is enclosed and/or sealed in a manner so that no material contained within the pouch can pass from the interior region to the exterior environment without passing through the diffusing membrane in some manner, either in particulate form, or for the optional second and third benefit agents, in the form of a particle, a liquid, a gas, a vapor, a volatilized substance and/or combinations thereof.

A non-limiting example of one typical construction means to form a pouch is to first form an open cylindrical tube comprising the desired diffusing membrane, which may involve joining and sealing two edges of a sheet of diffusing membrane material, leaving an open "top" and open "bottom" region of the cylinder with the walls forming a continuous circular membrane. A further typical step in the construction is then to form at least one additional perpendicular seal on the designated "bottom" region of the open cylindrical tube to effect a continuous seal along the bottom to form a sealed bottom region and thus providing a partial containment means being a pouch with one remaining open "top" region. Filing of the interior region of the pouch with the powdered benefit agent, and optionally with either a second and/or third benefit agent is then easily performed by hand or automatically in production mode. A final closing and sealing step is then typically employed to join the open "top" edges of the pouch to form a sealed top region, thereby effecting the complete closure and sealing of the diffusing membrane about an interior volume capable of containing from between 1 to 100 grams of at least one powdered benefit agent, and any additional materials, and thus effecting construction of a treatment article providing a containment means comprising the diffusing membrane.

Any suitable means known in the art to form a containment means according to the present invention is suitable. Further, any suitable means known in the art to form a pouch constructed of the diffusing membrane of the present invention is suitable. Such means may employ a sealing step, which can include the use of an adhesive, glue or binding means, or alternatively can include the use of a bonding process, such as for example the application of heat, ultrasonic energy, mechanical energy such as a crimping force, et cetera, to bond desired regions of the diffusing membrane together to form the flexible hollow containment means of the present invention.

In another embodiment of the treatment article of the present invention, a plurality of individual pouches may be formed from a continuous sheet, cylinder or other physical form of a diffusing membrane, and may optionally be separated after a filling step in which the benefit agents are placed within the interior volumes of each individual pouch, or may optionally not be separated so as to form a treatment article with a plurality of pouches joined together by an adjoining portion of the diffusing membrane.

Diffusing Membrane

The diffusing membrane of the present invention can be selected from any material capable of being formed into a pouch and having a porous nature capable of diffusing a powdered benefit agent from the interior region of the treatment article to an exterior environment. The diffusing membrane of the present invention may be selected from those materials comprising a porous water insoluble non-woven material having an average pore diameter of 250 microns to 1000 microns, and a thickness of less than 7.5 millimeters (mm). Also suitable as a diffusing membrane is a non-woven material having an average pore diameter of 250 microns to 500 microns, or alternatively of 500 to 1000 microns. Further, the diffusing membrane of the present invention may be a non-woven material having a thickness of equal to or less than 5 millimeters, or a thickness equal to or less than 2.5 millimeters, or a thickness equal to or less than 1.0 millimeter. Non-woven materials, in contrast to woven sheet membranes, provide additional tortuous paths that act to control particle diffusion across the membrane cross section, so that different ranges of average pore diameters of 250 microns to 1000 microns may be employed depending on the membrane thickness to achieve the desired powdered benefit agent release profile upon a tumbling action to which a treatment article constructed of the diffusing membrane is subjected to during a tumble drying operation.

The diffusing membrane of the present invention may be selected from those non-woven materials constructed of a bleach stable polymer. Suitable bleach stable polymers used to construct a non-woven material suitable for use as a diffusing membrane of the present invention include, but are not limited to, polyester, polypropylene, polyethylene, hydrophilically modified polyester, hydrophobically modified polyester, hydrophilically modified polypropylene, hydrophilically modified polyethylene and mixtures thereof. These materials are particularly preferred owing to their excellent hypochlorite bleach stability and near complete resistance to oxidant and chemical degradation under normal contact and storage conditions, thus ensuring the integrity and maintenance of the desired physical characteristics of the diffusing membrane when in the form of a treatment article having a powdered oxidant material in direct contact with the interior facing side of the diffusing membrane formed into a pouch containment means. In contrast, polymeric materials such as polyurethane, for example, do not have sufficient stability in the presence of a hypochlorite releasing material to serve as materials of construction for the diffusing membrane.

The diffusing membrane serves to diffuse or allow passage of the powdered benefit agent perpendicularly through its cross-sectional thickness at a controlled rate, particularly when the powdered benefit agent and/or second benefit agent mean particle size is roughly equal to or less than the average pore diameter of the diffusing membrane. Non-woven constructs are typically produced by either an wet-laid or melt-laid process employing a filament or fiber of the polymeric material of formation, thus resulting in diffusing membranes having fibrous matt-like random cross-sectional pore characteristics in contrast to the periodic and consistent pores formed by weaving of the filaments or fibers in construction of a woven membrane.

Non-woven constructs are generally preferred over woven constructs for use as a diffusing membrane owing to the nature of the tortuous paths produced during formation of the non-woven membrane which provide for more uniform release of powdered materials under tumbling conditions.

For the purposes of the present invention, it has been discovered that the porous nature of a treatment article in the form of a pouch constructed of a non-woven diffusing membrane provides for controlled yet complete release of a powdered benefit agent during a typical tumble drying process in which the pouch is tossed about and repeatedly brought into contact with damp fabrics and the interior walls of the tumble dryer, which however serves initially to effectively prevent premature release of the powdered materials during typical handling outside of the tumble dryer, for example during manufacture, handling, packaging and manual manipulation by a user prior to placement in the drum of the dryer.

Suitable materials for use as the diffusing membrane of the present invention include those commercial filter materials available under the Fiberweb™ and Reemay™ tradenames (Reemay, Old Hickory, Tenn., USA and BBA Fiberweb, West Chester, Ohio, USA). Non-limiting examples include Reemay™ filtration grade Fiberweb™ spunbonded polyester materials #2005, #2014, #2024, #2033, #2420 and #2440. These materials constitute trilobal filaments with fiber diameters of between 21 to 23 microns, with crimped or straight fibers, and basis weights ranging from about 19 to 100 grams per square meter (gsm).

Other suitable materials include polypropylene filter materials available from Fiberweb under the Typar™ and Tekton™ tradenames, or also under the LyPore™ tradenames from Lydall Filter/Separation Group, USA. Other suitable materials include polyethylene available from DuPont USA under the Tyvek™ and Solor Flo™ tradenames.

Other suitable materials are described in the "Handbook of Nonwoven Filter Media", authored by Irwin Marshall Hutten, published by Elsevier Press in 2007, ISBN 1856174417, which is hereby incorporated in its entirety by reference.

Frazier Air Permeability

Although the diffusing membrane may be characterized by its average pore diameter, the Frazier air permeability parameter may also be used to describe a preferred range of diffusibility values that meet the requirements of the treatment article of the present invention in releasing a powdered benefit agent under typical tumbling conditions found within a tumble dryer. It has been discovered that diffusing membranes having an average pore diameter of at least 250 microns and a Frazier air permeability parameter of between 1,000 to 8,000 liters/$m^2$/sec at 124 Pascals may suitably be employed in the present invention. An ASTM method designated "D-737" and entitled Air Permeability is suitably employed to determine the Frazier air permeability parameters of membranes. The permeability may be determined at lower pressures as well but is generally reported for high pressures of about 125 Pascals to enable cross comparison of characteristics.

Generally, materials having too low a permeability parameter of less than 1,000 liters/$m^2$/sec at 124 Pascals do not provide a suitable diffusing membrane capable of completely dispensing a powdered benefit agent over the duration of a typical tumble drying operation, which is between 30 to 60 minutes in duration. Also generally, materials having too high a permeability parameter of greater than 8,000 liters/$m^2$/sec at 124 Pascals may not adequately retain the powdered benefit agent within the treatment article under non-tumbling conditions incident to normal handling and manipulation by a user, for example.

Barrier Membrane

The treatment article of the present invention may optionally include a barrier membrane in the form of a membrane or coating that is placed around or on the exterior facing side of the diffusing membrane in the form of a pouch. The barrier membrane may be selected from the group consisting of a water degradable membrane or coating, a moisture degradable membrane or coating, a heat degradable membrane or coating, a friction degradable membrane or coating, a manually removable membrane or coating, and/or combinations thereof.

Figure 2:
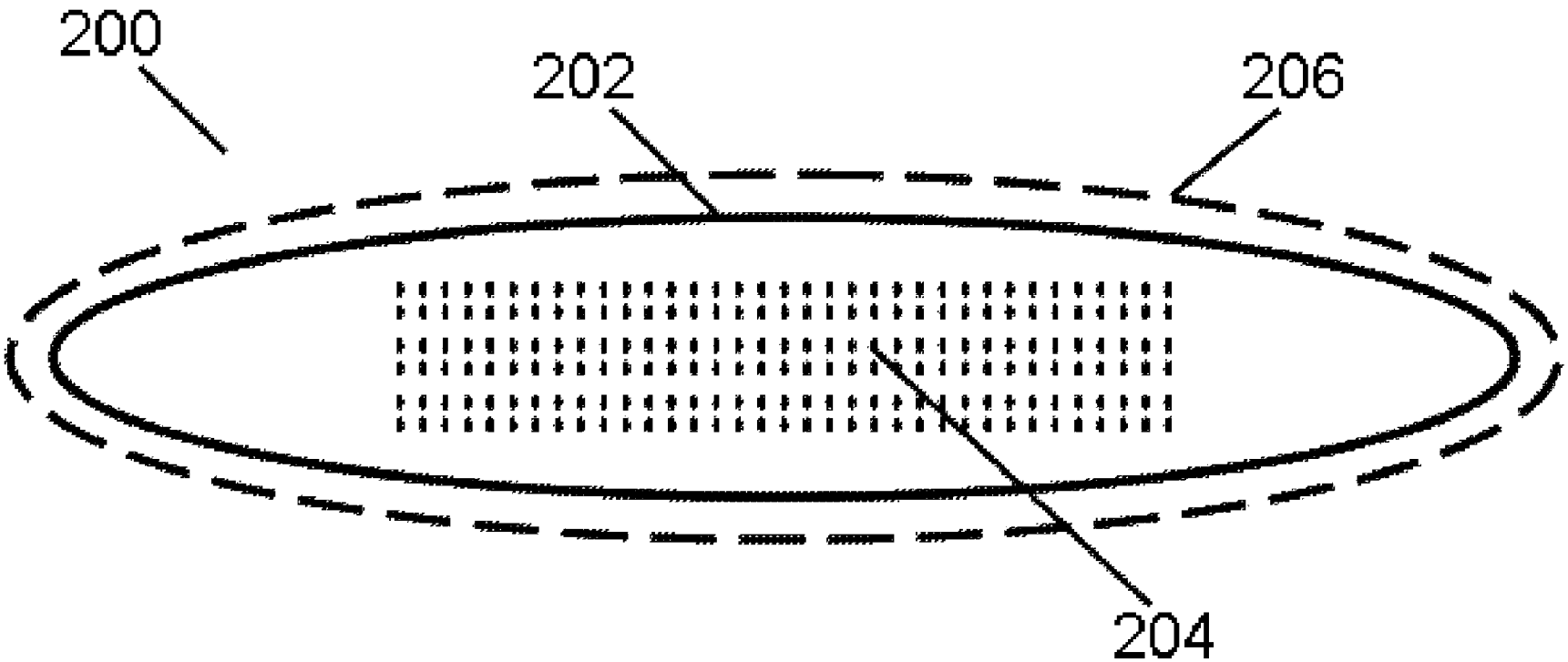
FIG. 2 is an illustration of a treatment article in the form of a pouch (200) with a diffusing membrane (202) forming a containment means and being wholly surrounded by a barrier membrane (206) in the form of a membrane or coating which prevents the premature release of a powdered benefit agent (204).
Figure 3:
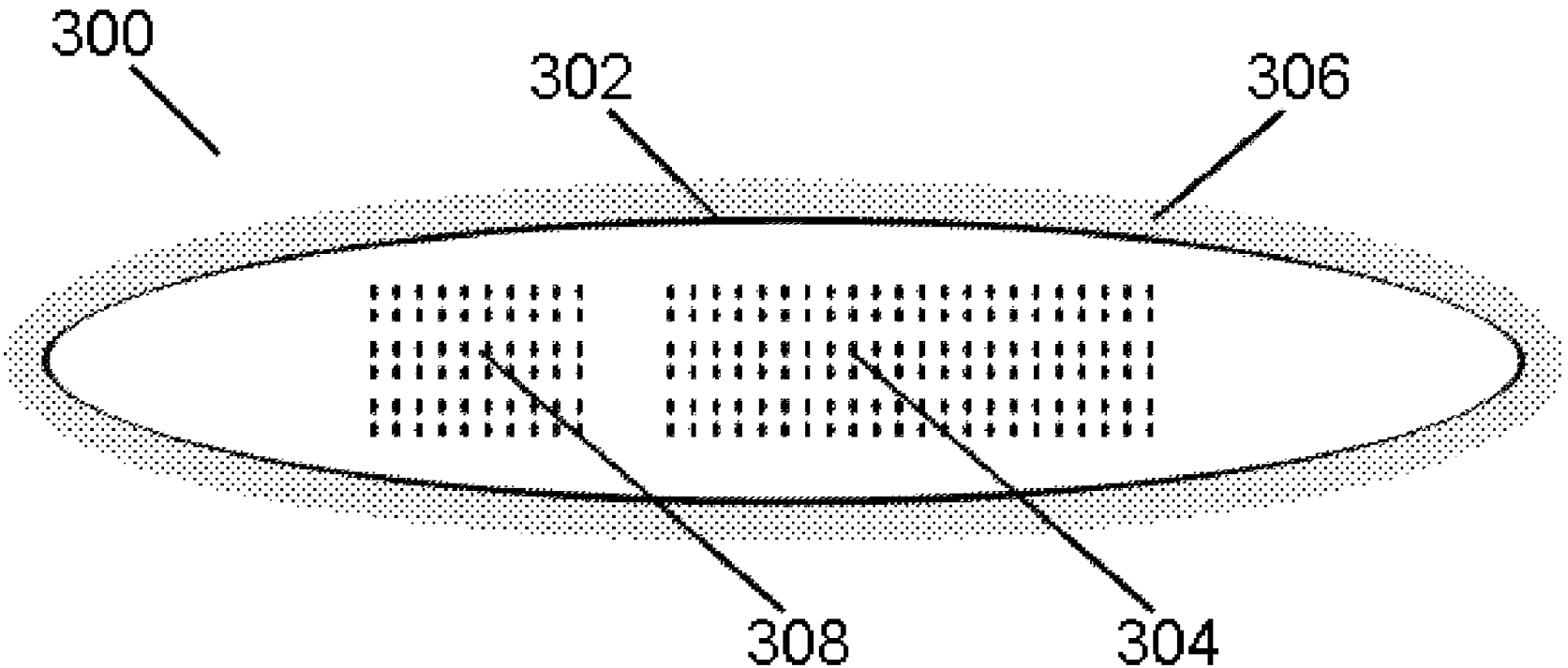
FIG. 3 is an illustration of a treatment article in the form of a pouch (300) with a diffusing membrane (302) forming a containment means and being wholly surrounded by a barrier membrane (306) in the form of a coating on the exterior surface of the diffusing membrane and which prevents the premature release of a powdered benefit agent (304) and of a second benefit agent (308) present in the form of secondary particles.
Figure 4:
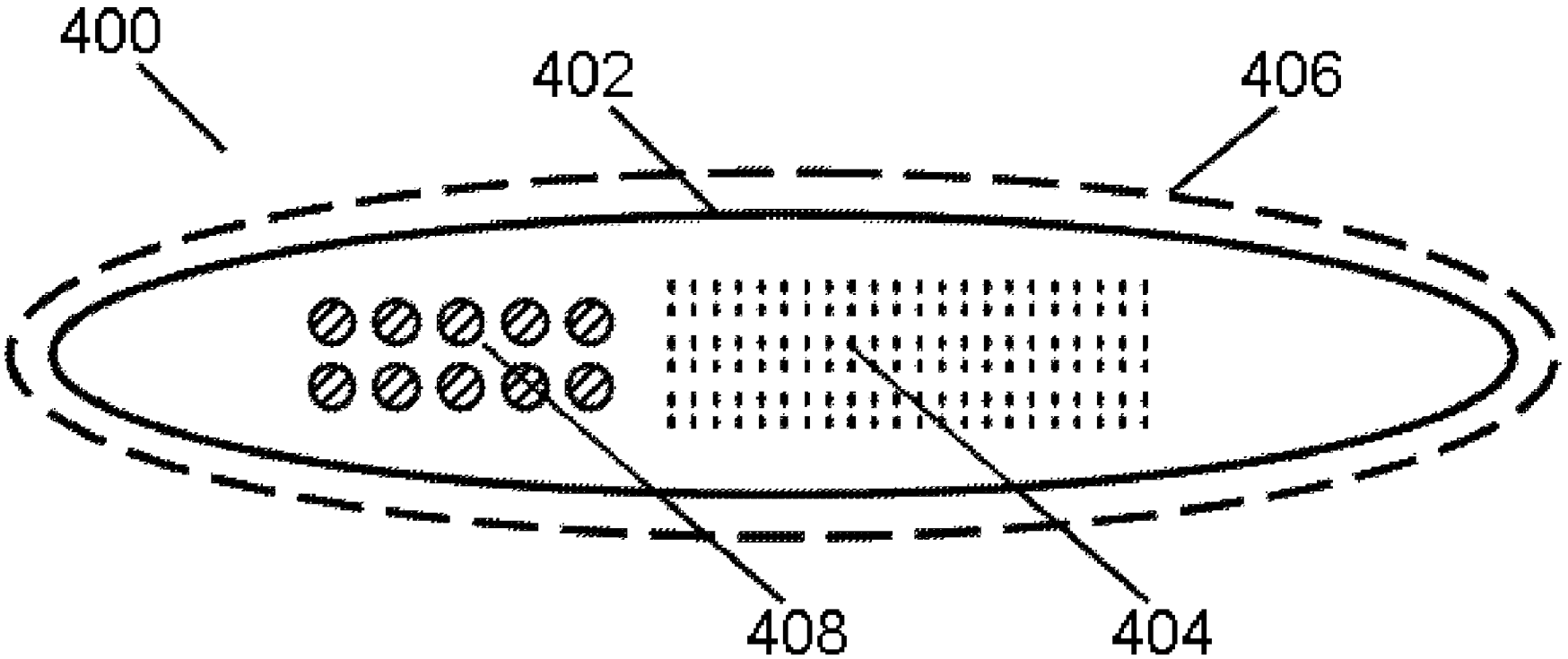
FIG. 4 is an illustration of a treatment article in the form of a pouch (400) with a diffusing membrane (402) forming a containment means and being wholly surrounded by a barrier membrane (406) in the form of a membrane or coating which prevents the premature release of a powdered benefit agent (404) being an oxidant material and of a third benefit agent (408) being a tertiary particle having an initial mean tertiary particle size value that is greater than the average pore diameter of the diffusing membrane (402).

FIG. 2 shows a barrier membrane (206) that totally surrounds the exterior facing side of the diffusing membrane that forms a wall of a dispensing article in the form of a pouch according to the present invention. FIG. 3 shows another example of a barrier membrane (306) present on the exterior face of the diffusing membrane and that intimately contacts the exterior surface of the barrier membrane in the form of a continuous and non-interrupted coating thereon.

One purpose of the barrier membrane is to augment the initial barrier properties of the diffusing membrane against premature release of the powdered benefit agent and other optional benefit agents present within one or more pouches of the inventive treatment article. Under tumble drying conditions, in which the treatment article comes repeatedly into contact with damp or wet fabrics and/or the interior walls of the tumble dryer, the barrier membrane is ideally decomposed and/or degraded so as to no longer prevent or interfere with the function of the diffusing membrane. Because moisture, heat and mechanical action within the tumble dryer are all available forms of energy and action brought to bear on the tumbling treatment article, a wide variety of barrier membranes in the form of a membrane or coating may suitably be employed using any known materials in the art that are effectively degraded or removed under conditions of heat, moisture or mechanical friction. Alternatively, the barrier membrane may be of such a nature that mechanical removal by a user prior to use of the treatment article is required.

Non-limiting examples of a barrier membrane comprising a membrane material is an over package of a non-porous continuous plastic film that totally surrounds and contains the treatment article of the present invention, and/or a secondary outer pouch, bag, container, box, shrink wrap or the like, being flexible, semi-flexible or rigid in nature, which serves as a container to hold the treatment article and prevent any release of its contents while the membrane material remains in place.

Non-limiting examples of a barrier membrane comprising a coating material includes any application of a material in the form of a film, coating, layer, laminate, gel, solid or other suitable material form that contacts the outer exterior facing side of the diffusing membrane and effectively prevents any release of the contents of the treatment article while the coating material remains in place.

The coating material is also selected as appropriate to exhibit the degradation and/or decomposition behavior desired to effect release of the contents of the treatment article at the desired time or conditions within a tumble dryer machine.

Non-limiting examples of a barrier membrane in the form of a coating material include the use of materials applied as a thin film or coating on the exterior of the diffusing membrane that are susceptible to one or more of heat, moisture or mechanical friction. Non-limiting examples of such materials include a fatty substance, wax, starch, a water soluble and/or dispersible polymer, fabric softening quaternary compound, a surfactant, an anhydrous powder, and the like.

The thickness of the barrier membrane for the purposes of the present invention is typically selected to be less than about 7.5 millimeters (mm), or alternatively less than about 5 mm, or alternatively less than or equal to 1 mm, comparable in thickness to that of the diffusing membrane.

In general, any material capable of providing some barrier function as a barrier membrane in the form of a membrane and/or coating may be employed in the present invention.

Powdered Benefit Agent

The primary powdered benefit agent of the present invention is an oxidant material in the form of a powder that when placed within a flexible hollow pouch formed from a suitable diffusing membrane can pass from the interior region to an outer exterior environment, i.e. the interior of a tumble dryer machine under typical tumbling and agitation that the pouch is subjected to during a drying operation in order to effect transfer of the powdered benefit agent to the surface of initially damp and/or wet fabrics present in the tumble dryer machine.

The powdered benefit agent of the present invention is an oxidant material in the form of particles having a mean particle size of at least 250 microns. The oxidant materials of the present invention are selected from those chlorine-based bleaching agents having the desired properties of particle size, solubility in water and/or granular characteristics suitable for use as a powdered benefit agent releasable from a treatment article. In one suitable embodiment, the oxidant materials representing a first powdered benefit agent be is the form of a substantially 100% active material, that is to say in the purest or most active form available as a single molecular species of a bleaching agent or mixed molecular species representing common isomers, tantomeric forms, hydrated forms and/or complexes of a bleaching agent, rather than a powdered composition containing the active bleaching agent in combination with an inactive material such as a filler, binder, carrier agent, carrier particle and/or compositional adjunct having no oxidant functionality. For purposes of the present invention, use of the bleaching agent in its essentially pure state, whether in the form of a crystal, powder, agglomerate, aggregate and/or combination thereof, enables use of the lowest possible physical quantity of the bleaching agent to achieve the one or more desired fabric benefits, while minimizing any unwanted residue that may remain on the surface of a treated fabric following treatment using a treatment article employing the oxidant. Alternatively, where a gentler treatment is desired, a bleaching composition comprising an active bleaching agent in combination with a non-active material, such as a carrier particle on which the bleaching agent has been loaded, may be employed to effect treatment of a fabric to achieve one or more fabric benefits described herein. In such embodiments, the powdered benefit agent of the present invention would comprises a carrier particle releasably containing the oxidant material and where the carrier particle has a mean particle size of at least 250 microns.

Accordingly, in one embodiment, 1 gram of a high strength bleaching agent (one having greater than 50 weight % equivalent as available chlorine content) may be sufficient to completely sanitize a full dryer load of wet towels weighing 6 lbs in their dry state. To achieve treatment of greater weights of fabric, larger quantities of a bleaching agent may be employed. Without being bound by theory, the inventors believe that an upper limit of about 100 grams of an oxidant material selected from those suitable chlorine-based bleaching agents would be sufficient for most home and commercial applications employing the treatment article of the present invention. Obviously, the amount of oxidant material would be preselected to achieve the desired fabric benefit without excess material being present.

Suitable chlorine-based bleaching agents include those materials having a water solubility of at least 25 grams per 100 grams of water at 25° C., or alternatively of at least 10 grams per 100 grams of water at 25° C., or yet alternatively of at least 1 gram per 100 grams of water at 25° C.

Suitable chlorine-based bleaching agents include those materials having a mean particle size value of 250 microns to 500 microns, or alternatively an initial mean particle size value greater than 250 microns and less than or equal to 2 times the average pore diameter of the diffusing membrane, or yet alternatively, an initial mean particle size value greater than 250 microns and less than or equal to 1.5 times the average pore diameter of the diffusing membrane, or yet alternatively, an initial mean particle size value greater than 250 microns and less than or essentially equal to the average pore diameter of the diffusing membrane.

The primary powdered benefit agent is dispersed from the treatment article of the present invention by a process of diffusion through the diffusion membrane while the treatment article is undergoing tumbling during a tumble drying process, the manner and rate of diffusion through the diffusing membrane dependant upon the mean particle size of the particles of the oxidant material in relation to the pore size and thickness of the diffusing membrane.

In embodiments employing chlorine-based bleaching agents with an initial mean particle size that are essentially equal to or greater than the average pore diameter of the diffusing membrane, the initial mean particle size is selected to be such that no appreciable amount of the bleaching agent in the form of a powdered benefit agent is released from the pouch initially, but which upon the start of the tumble drying process are selected to undergo a reduction in particle size owing to either mechanical or chemical action, such that with continued mechanical or chemical action the mean particle size of a plurality of powdered bleaching agent is reduced sufficiently to provide for the complete release of the contents of the treatment article to the interior of the tumble dryer.

Non-limiting examples of suitable bleaching agents capable of mean particle size reduction from an initial mean particle size upon application of either mechanical or chemical action include those materials in the form of low to medium bulk density aggregates and/or agglomerates of primary oxidant particles and/or oxidant crystals that are friable in nature and tend to degrade to component particles of reduced size.

Alternatively, another non-limiting example of suitable bleaching agents are those chlorine-based bleaching agents having hydrated forms with at least one or more molar equivalents of bound water. Non-limiting examples of solid chlorine-based bleaching agents with a least one water of hydration include hydrated chlorinated trisodium phosphate having an approximate formula of $(Na_3PO_4.11H_2O)_4.NaOCl$, representing a crystalline complex of hydrated trisodium orthophosphate and sodium hypochlorite; calcium hypochlorite dihydrate, $Ca(OCl)_2.2H_2O$; and dibasic calcium hypochlorite dihydrate, $Ca(OCl)_2.Ca(OH)_2.2H_2O$.

Another non-limiting example of a solid chlorine-based bleaching agent is sodium dichloroisocyanurate dihydrate with two moles of water of hydration, also known as sodium dichloro-s-triazinetrione dihydrate or "Dichlor" in the popular literature.

Oxidant materials suitable for use in this invention include chlorine-based bleaching agents. Such chlorine-based bleaching agents suitable for use in the present invention are those water soluble materials which either generate hypochlorite ions when dissolved in water or form hypochlorous acid either in water or in the form of a gas. Non-limiting examples thereof are the heterocyclic N-chloroimides such as trichlorocyanuric acid, di-chloroisocyanuric acid and salts thereof, such as potassium dichloroisocyanurate, sodium dichloroisocyanurate and sodium dichloroisocyanurate dihydrate. Other imides may also be used such as N-chlorosuccinimide, N-chloromalonimide, N-chlorophthalimide, and [(monotrichloro)-tetra-(mono-potassium dichloro)]-pentaisocyanurate. Other imides which are useful are hydantoins such as 1,3-dichloro-5,5-dimethylhydantoin, N-monochloro-5,5-dimethylhydantoin, methylene-bis (N-chloro-5,5-dimethylhydantoin), 1,3-dichloro-5-methyl-5-iso-butylhydantoin, 1,3-dichloro-5-methyl-5-ethyl-hydantoin, 1,3-dichloro-5,5-diisobutylhydantoin, 1,3-dichloro-5-methyl-5-n-amylhydantoin. Also useful are various inorganic compounds such as lithium hypochlorite, calcium hypochlorite and chlorinated trisodium phosphate. Additional useful organic compounds are trichloromelamine, N-chloromelamine, monochloramine, dichloramine, para-toluene sulfondichloroamide, N,N-dichloroazodicarbonamide, N-chloroacetyl urea, N,N-dichlorobiuret, chlorinated dicyandiamide, di-chloroglycoluril, N,N-dichlorobenzoylene urea, and N,N-dichloro-p-toluenesulfonamide.

These hypochlorite-generating agents may be used in the form of crystalline or granular particles. Also suitable for use in the present invention are those oxidant materials in the form of low bulk density granular particles.

The powdered benefit agent provides at least one primary fabric benefit to a fabric treated using a treatment article in a method according to the present invention, the primary fabric benefit being at least one of a bleaching benefit, whitening benefit, stain removal benefit, odor removal benefit, mildew removal benefit, decontamination benefit, sanitization benefit, disinfection benefit, sterilization benefit, and/or combinations thereof.

Depending on the size of the drum of the tumble dryer, the amount of fabric to be treated and the extent of mechanical tumbling action and its duration, differing quantities of the powdered benefit agent may need to be employed to achieve one or more of the desired primary fabric benefits. Typically, between 1 to 100 grams of powdered oxidant material should be sufficient for home and commercial laundry treatment of fabrics.

Second Benefit Agent

Optionally, a second benefit agent comprising a secondary benefit material in the form of secondary particles having a mean secondary particle size of between 100 to 1000 microns may further be employed in the treatment article of the present invention.

FIG. 3 shows an embodiment of a treatment article (300) of the present invention in which a second benefit agent (308) is present in the pouch in addition to the primary powdered benefit agent (304). The powdered benefit agent and secondary benefit agent may be combined in any manner known in the article inside the barrier membrane (302), such as for example, as a uniform mixture or unmixed aliquots of each agent. In one embodiment represented by FIG. 3, the treatment article is in the form of a pouch bearing a barrier membrane (306) in the form of a barrier coating that is uniformly adherent to and coating the exterior facing side of the diffusing membrane (302).

The second benefit agent may be selected from any typical adjunct employed in the art to treat home and/or commercial laundry articles, including, but not limited to, any suitable substantially dry powdered form or substantially dry particle acting as a carrier of the second benefit agent, the latter being one or more of a material selected from the group consisting of accaricides, antisoiling agents, antistatic agents, antimicrobials, brighteners, bluing agents, buffers, clays, chelants, disinfectants, dye fixatives, dye release agents, fabric softeners, fabric-modifying polymers, fluorescent whitening agents, fragrances, miticides, perfumes, pigments, polymers, sanitizers, surfactants, stain release agents, ultraviolet light absorbers, ultraviolet light blockers, whiteners, and combinations thereof.

The second benefit agent is dispersed from the treatment article of the present invention in a similar manner to dispersal of the primary powdered benefit agent; the second benefit agent being diffused through the diffusing membrane in a manner dependant upon the mean secondary particle size of the secondary particles of a secondary benefit material in relation to the pore size and thickness of the diffusing membrane. In one embodiment the second benefit material may be selected to have a mean secondary particle size that tends to pass more easily through the pores of the diffusing membrane than the primary benefit agent, for example having a mean particle size of between about 100 to 250 microns or so, so that the second benefit agent tends to be dispersed more rapidly and/or earlier in a tumble dry process than the primary powdered benefit agent. In another embodiment the second benefit material is selected to have a mean secondary particle size of between about 500 to 1000 microns, being greater than that of the primary powdered benefit agent, so that the second benefit agent tends to be dispersed less rapidly and/or later in a tumble dry process than the primary powdered benefit agent. In yet another embodiment the mean particle size of the secondary particles of the secondary benefit material is roughly equivalent to the mean particle size of the primary powdered benefit agent so that the secondary benefit agent is dispersed at a similar rate and time as the oxidant material of the primary powdered benefit agent.

Third Benefit Agent

Optionally, a third benefit agent comprising a third benefit material in the form of a tertiary particle having an initial mean tertiary particle size value that is at least two (2) times greater than the average pore diameter of the diffusing membrane may further be employed in the treatment article of the present invention. Essentially, the tertiary particles of the third benefit agent are selected so as to have an initial mean tertiary particle size that prevents and/or reduces the ability of the tertiary particles to diffuse through the diffusion membrane even under rigorous tumbling action during the tumble drying process. Further, the tertiary particles of the third benefit agent are composed of a third benefit material that can undergo one or more changes in character that result in a reduction in the mean tertiary particle size with respect to the initial mean tertiary particle size and correspondingly result in an increased ability of the third benefit agent to be diffused through the diffusing membrane.

The one or more changes in character that result in a reduction in the mean tertiary particle size of a third benefit material comprising the third benefit agent of the present invention includes at least one of a phase change, a physical change and/or a chemical change when heated to a temperature above 40° C. Further, during the one or more changes resulting from an increased temperature in excess of 40° C., the third benefit material is a material capable of being released from the pouch through the diffusing membrane when in the form of a liquid, a gas, a vapor, a volatilized substance and/or combinations thereof.

In one embodiment of the present invention, the third benefit agent is in the form of a tertiary particle comprising a carrier particle coated with a higher melting point quaternary cationic fabric softener ("quat") so as to have an initial mean tertiary particle size value that is at least two (2) times greater than the average pore diameter of the diffusing membrane, so that substantially no initial release of the third benefit agent from a treatment article occurs in the beginning of the tumble dry process. In this same embodiment, a temperature increase at some stage in the tumble dry process serves to melt the quat (a phase change from its normal room temperature form as a solid to a transient liquid form above the quat melting point) thereby enabling the quat to pass through the pores of the diffusing membrane more readily being in a free flowing liquid state. In this same embodiment, the mean particle size of the carrier particle may be selected so that once its maximum reduction in size occurs it is then either small enough in size to be diffused through the diffusing membrane; or alternatively remain large enough in size to not be diffused through the diffusing membrane.

In other embodiments of the present invention, the third benefit agent may be in the form of a tertiary particle comprising a hydrated swellable material such as a water absorbent polymer in particulate form which undergoes a physical change upon heating whereby physically absorbed water is released upon a temperature increase with concomitant reduction in the mean particle size as the water absorbent polymer deswells upon loss of water.

In other embodiments, the third benefit agent is a third benefit material that can undergo a chemical change, such as for example, but not limited to an oxidation reaction, hydration reaction, hydrolysis reaction, addition reaction, esterification reaction, reduction reaction, thermal decomposition, isomeric rearrangement, deamination reaction, and the like, whereby the third benefit agent is activated and/or synthesized in situ during the tumble dry process in the form of a reaction product resulting from the action of heat applied to the third benefit material when subjected to a temperature of above 40° C.; and whereby the third benefit agent thus produced is capable of being released through the diffusing membrane in the form of a liquid, a gas, a vapor, a volatized substance and/or combinations thereof.

In one embodiment, the third benefit agent is a fragrance material, being present initially as a third benefit material comprising a profragrance (fragrance precursor) in the form of a non-reactive carrier particle, such as a silica particles, having an initial mean tertiary particles size and bearing the profragrance as a reactant and a catalytic agent, such as a solid organic acid with a melting point of less than 40° C. In this embodiment, the third benefit material undergoes a chemical reaction upon heating above 40° C. whereby the melting of the solid acid results in an acidic hydrolysis reaction liberating a volatile fragrance from the profragrance reactant precursor, thus producing a fragrance material which is capable of diffusing through the diffusing membrane in the form or a gas and/or vapor. In this same embodiment, the carrier particle serves solely as a carrier and does not undergo a change in mean particle size from its initial mean tertiary particle size, and so would in this example be substantially retained inside the treatment article if the initial mean tertiary particle size was selected to be at least two (2) times greater than the average pore diameter of the diffusing membrane.

Method of Treating a Fabric

A method for treating a fabric during a tumble drying process to deliver at least one powdered benefit agent to the fabric comprises the first steps of: (a) placing at least one treatment article according to the present invention in the interior drum of a tumble dryer machine; and (b) placing at least one fabric in said drum; wherein the at least one fabric is damp and/or wet with water when placed in said drum; and wherein steps (a) and (b) may be performed in any order and/or simultaneously. The method then further involves the step of (c) initiating a drying cycle of the tumble dryer machine sufficient to subject the fabric to heat at a temperature in the range of from about 40° C. to about 100° C. for at least 10 minutes during a period of the drying cycle to effect treatment of the fabric and to render it in a dried state for removal from the dryer. The method also provides for the step of (d) tumbling the treatment article with the fabric for a time sufficient for at least 75% of a powdered benefit agent to be released from the treatment article in order to contact the fabric and to thus provide at least one fabric benefit effect on the fabric; wherein the time sufficient for at least 75% of the powdered benefit agent to be released is less than or equal to 20 minutes. The method then provides for an intermediate step of (e) substantially drying the fabric so that a plurality of any remaining, undissolved powdered benefit agent particles that may remain on the surface of the dried fabric are effectively detached from the fabric. Finally, the method then provides the final step of (f) allowing said fabric to cool to ambient temperature; whereby a primary fabric benefit has been provided to the fabric. Thus followed, the method of treating a fabric with a treatment article according to the present invention results in the delivery of at least one primary fabric benefit to the fabric, where such benefit is selected from a bleaching benefit, whitening benefit, stain removal benefit, odor removal benefit, mildew removal benefit, sanitization benefit, disinfection benefit, sterilization benefit, and/or combinations thereof.

Also encompassed by the present invention are those variations, alterations and/or adjustments to the method necessitated by use of a particular tumble dryer in order to complete a tumble dry process with a treatment article and at least one fabric to achieve at least one primary fabric benefit as described herein.

Treatment Kit

The present invention also provides for a treatment kit comprising a treatment article as described herein along with instructions for using the treatment kit. The instructions of use regarding the present invention instruct the use of a treatment article with a substantially bleach resistant fabric so as to effectuate the treatment kit being used in a manner that provides at least one fabric benefit to a fabric treated in a tumble drying process according to the method of use described herein. The treatment kit of the present invention may be used to treat fabrics while they are being dried in a tumble drying process within a tumble dryer to achieve at least one additional fabric benefit selected from the group consisting of a bleaching benefit, whitening benefit, stain removal benefit, odor removal benefit, mildew removal benefit, decontamination benefit, sanitization benefit, disinfection benefit, sterilization benefit, and/or combinations thereof.

EXAMPLES

Experimental treatment articles were prepared and tested in developing the treatment articles, methods and treatment kits of the present invention. Testing was conducted in a standard electric powered Whirlpool brand tumble dryer equipped with a temperature monitor to allow the average internal air temperature of the drum to be monitored over time. All tumble drying tests were performed using approximately six (6) pounds of assorted mixed 50% Cotton-50% Polyester pillow cases serving as ballast, the weight being the dry weight of the materials before being washed with Liquid Tide detergent (commercially available from Procter & Gamble, Midland, Mich., USA) in a regular top loading washing machine and then drained and spun for approximately 15 minutes to reduce the ballast to the typical degree of wetness following a washing operation, and thus being representative of both the amount and the state of dampness of clothing that is typically being put into a dryer to be dried.

In addition to the damp ballast, 100% cotton test flags bearing selected stains and soils were also introduced in some experiments in order to determine the effectiveness of the primary benefit agent to bleach and/or remove stains under varying experimental conditions and selection of particles sizes and diffusing membrane characteristics. When used, the relative ranking of stain and soil removal on a simple order of effect scale (i.e. cardinal number of "1" being assigned to that treatment having the best stain and soil removal, followed by "2" representing the next best stain and soil removal, up to "n" samples tested) was determined visually by the operator after completion of the treatment by observing the treated test flag side by side with other flags under uniform fluorescent lighting conditions.

Most experimental treatment articles were prepared in the form of a square or rectangular pouch solely for ease of fabrication for test purposes. While any suitable material may be employed as a diffusion membrane according to the present invention, test articles were generally made using a calendared spunbonded Reemay™ nonwoven polyester material available from BBA Fiberweb Inc., Old Hickory, Tenn., USA under their Fiberweb™ filtration grade series of materials designated #2005, #2014, #2024, #2033, #2420 and #2440. These materials are in the form of thin sheets formed from trilobal filaments with fiber diameters of between 21 to 23 microns, with either crimped or straight fibers, and basis weights ranging from about 19 to 100 grams per square meter (gsm), having a sheet thicken of between about 0.18 to 0.53 millimeters (mm) depending on the series number. The 2400 series have crimped fibers of 23 micron diameter, while the 2000 series have straight fibers of 21 micron diameter.

Experimental treatment articles in the form of square or rectangular pouches were generally prepared from the sheet membrane material by folding over and sealing the seams using a temperature resistant hot melt adhesive, although any manner of sealing known in the art would be suitable. Generally, all seals but one were completed prior to addition of the powdered benefit agent(s) to enable easy loading of each pouch without loss of material, the pouch then being sealed. Weights taken before and after filling, and as needed before and after the final sealing operation established a starting weight used to monitor weight changes in the pouch after construction.

To measure the dispensing characteristics of sample treatment articles, the pouches tested were initially weighed and then placed in a tumble dryer machine with damp ballast as described above, and a dryer cycle initiated. The same tumble dryer was used for all testing. At periodic time periods, such as 10, 20, 30 and 40 minutes from the start of the cycle, the dryer was stopped and the pouches removed and weighed. Because of the nature of the polymer used, the pouches did not appear damp or wetted by appearance, and so are not believed to have gained any weight owing to contact with damp fabrics. Rather, decreases in the pouch weights over time reflected the loss of particulate material under tumbling conditions.

For test purposes, a powdered chlorine-based bleaching agent, sodium dichloroisocyanurate dihydrate, sometimes referred to as "Dichlor", was used as a powdered benefit agent, being a strong oxidant material that has 63 weight % active chlorine content. A commercial source designated ACL 56, available in granular form from OxyChem (Occidental Petroleum Corp, USA) was obtained and then ground to produce finer particle size distributions of the powdered benefit agent by use of a common coffee grinder, enabling production of test batches of powdered bleach having mean particle sizes spanning from below 250 microns to over 500 microns. After grinding of the commercial product in this manner, the grindings were sieved on a series of stacked standard sieves to monitor particle sizes, and resulting mean particle size distributions, as well as to obtain sufficient amounts of materials across discrete particle size fractions for test purposes. Fractions having particles sizes below about 250 microns in size tended to be very dusty and easily scattered, handling being difficult to control. Further, when attempting to use for purposes of a treatment article according to the present invention, these fine particle fractions of below about 250 microns released too readily from the test pouches—even with slight manipulation by the user, and so are not preferred. Additionally, fractions having particle sizes of greater than about 500 microns appeared to have slower dissolution rates on the surface of damp test fabrics, and are thus not ideal for use in the treatment article of the present invention owing to their increased tendency to produce spot damage owing to excessive oxidant concentration on the surface of the test swatch at and surrounding the contact region.

Testing confirmed the surprising results that selection of a powdered benefit agent in the form of oxidant particles having mean particle sizes of at least about 250 microns and up to about 500 microns were capable of being readily released into the dryer under tumbling conditions without a tendency to prematurely release during user manipulation, and yet also dissolve rapidly on the surfaces of the damp fabrics present in the tumble dryer so as not to cause any noticeable spot damage. Further, it was surprisingly noted that proper selection of a material to act as a diffusion membrane and having a pore size of the same order of magnitude or greater than the average mean particle size of a powdered benefit agent enable was effective for the controlled and uniform dispensing of a powdered material. It is to be noted that when discussing a plurality of particles, such as present in a commercial sample such as Dichlor, or when preparing a selected powdered benefit agent for the purposes of the present invention, the particles present are typically exhibiting a normal Gaussian-style particle size distribution and thus may have present a plurality of individual particles exhibiting a wide range of sizes but whose overall average size is represented as a single "mean" or "average" value of the distribution range.

Sample sizes of about 4.0 grams of the Dichlor material were found sufficient to produce the desired textile benefits for the size of dryer and weight of ballast employed for test purposes—one benefit being determination of the ultimate stain removal performance on a series of typical household soils present on a soiled 100% cotton flag.

In addition, a dark colored test fabric, dampened and treated identically to the fabric ballast, was also employed to examine the uniformity of dispersal of the powdered benefit agent from the treatment article to the surface of that test fabric during a tumble dryer operation. The white Dichlor crystals employed for test purposes are quite visible to the eye so that their distribution and dissolution onto the damp fabric can be observed by eye.

Figure 5:
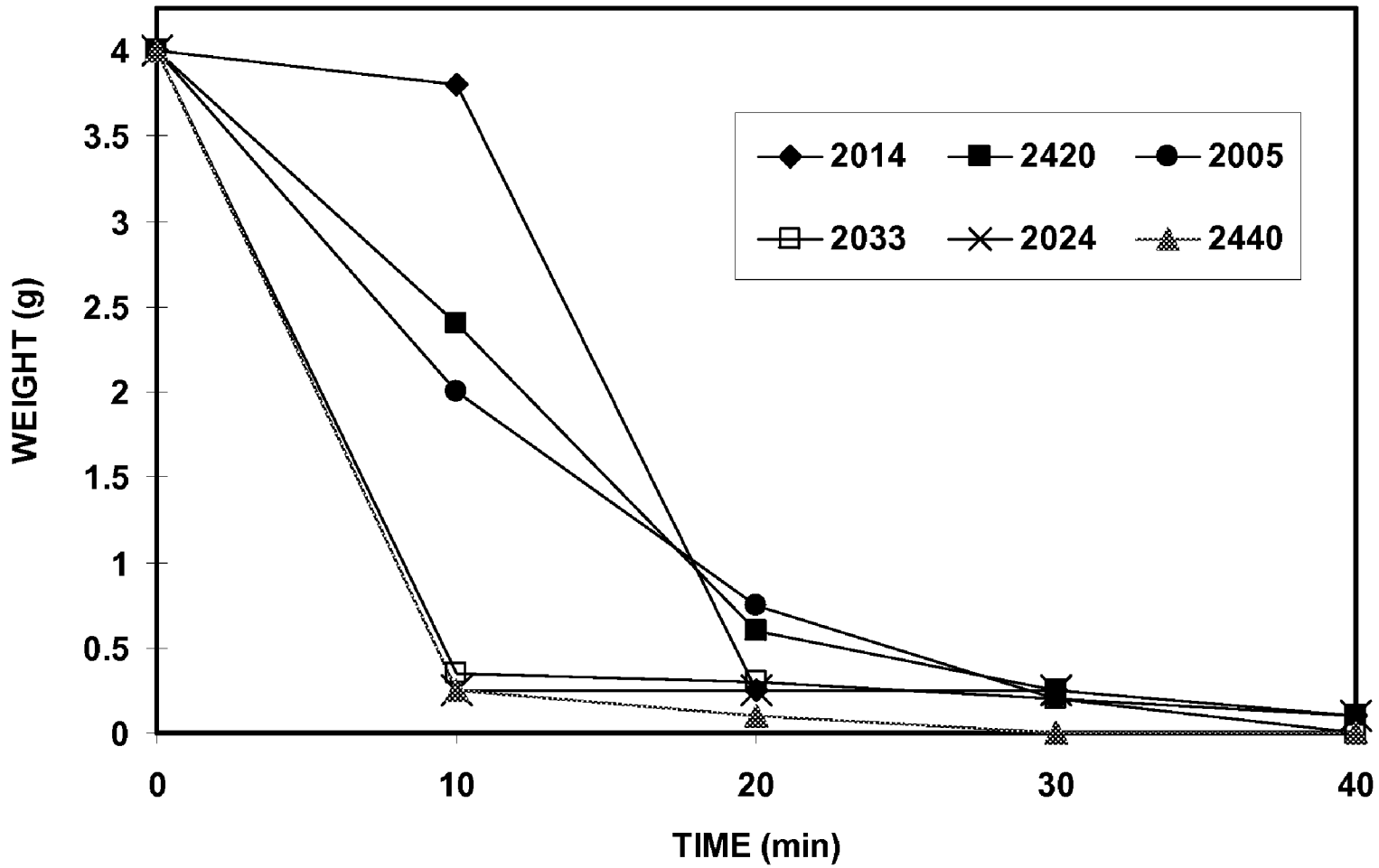
FIG. 5 is a graph showing the weight over time of experimental treatment articles in the form of pouches constructed of a commercial polyester diffusion membrane initially holding 4.0 grams of a powdered chlorine-based oxidant after being tumbled in a tumble dryer for the indicated time.

FIG. 5 illustrates the results of one test run in which a 4.0 gram quantity of ground ACL 56 Dichlor particles as the oxidant material were employed in a series of treatment articles in the form of pouches constructed using the Fiberweb™ series of filter materials as the diffusion membrane according to the present invention. Pouches were marked and at 10 minutes interval the dryer was stopped and pouches removed for weighing, then placed back into the dryer and the drying cycle resumed until the next 10 minute mark. All traces thus begin at 4.0 grams. Each filter material showed a unique delivery profile, the 2024, 2033, and 2440 materials all acting as diffusion membranes providing greater than 75% release of the powdered benefit agent within 10 minutes of initiation of tumbling. Other filter materials, including 2005, 2014 and 2420 demonstrated at least 75% release of the powdered oxidant material within 20 minutes of initiation of tumbling. All test samples provided very good bleaching effect on the stained test flags present.

From these results it is obvious that some variations in selection of the mean particle size of a desired powdered benefit agent, as well as that of any optional second and third benefit agents, and variations in the selected characteristics of a diffusing membrane as to its average pore diameter and membrane thickness are possible to achieve the objects and goals of the present invention.

The above specification, examples and data provide a complete description of the manufacture and use of the treatment article, method of use and treatment kit of the present invention employing the same. Since many embodiments of the invention can be made without departing from the spirit and scope of the invention, the invention resides in the claims hereinafter appended.

We claim:

1. A treatment article for treating a fabric during a tumble drying process to deliver at least one benefit agent to the fabric, said treatment article comprising:

(a) at least one pouch which dispenses at least one powdered benefit agent during the drying process, said pouch comprising:

i. a flexible hollow containment means comprising a diffusing membrane separating and totally surrounding an interior region from an outer exterior environment;

wherein said containment means has an interior volume capable of containing from between 1 to 100 grams of at least one powdered benefit agent;

wherein said diffusing membrane provides the only communication means for migration of the powdered benefit agent between the interior region and the outer exterior environment;

wherein said diffusing membrane comprises a porous water insoluble non-woven material having an average pore diameter of 250 microns to 1000 microns, and a thickness of equal to or less than 1 millimeter;

wherein said non-woven material comprises a bleach stable polymer;

(b) a powdered benefit agent comprising an oxidant material in the form of particles having a mean particle size of at least 250 microns; wherein said oxidant material comprises a chlorine-based bleaching agent; and wherein said powdered benefit agent particles are released from said pouch when the dryer temperature is in the range of from about 60° C. to about 100° C.;

(c) optionally, a second benefit agent comprising a secondary benefit material in the form of secondary particles having a mean secondary particle size of between 100 to 1000 microns; and (d) optionally, a third benefit agent comprising a third benefit material comprising a tertiary particle having an initial mean tertiary particle size value that is at least 2 times greater than the average pore diameter of the diffusing membrane; wherein said third benefit agent undergoes at least one of a phase change, a physical change and/or a chemical change when heated to a temperature above 60° C.; said tertiary benefit agent being capable of being released from said pouch through said diffusing membrane when in the form of a liquid, a gas, a vapor, a volatilized substance and/or combinations thereof.

2. A treatment article according to claim 1, wherein said diffusing membrane has an average pore diameter of 250 microns to 500 microns.

3. A treatment article according to claim 1, wherein said diffusing membrane has an average pore diameter of at least 250 microns and a Frazier air permeability parameter of between 1,000 to 8,000 liters/$m^2$/sec at 124 Pascals.

4. A treatment article according to claim 1, wherein said bleach stable polymer is selected from the group consisting of polyester, polypropylene, polyethylene, hydrophilically modified polyester, hydrophobically modified polyester, hydrophilically modified polypropylene, hydrophilically modified polyethylene and mixtures thereof.

5. A treatment article according to claim 1, wherein said chlorine-based bleaching agent has a water solubility of at least 25 grams per 100 grams of water at 25° C.

6. A treatment article according to claim 5, wherein said chlorine-based bleaching agent has a water solubility of at least 10 grams per 100 grams of water at 25° C.

7. A treatment article according to claim 5, wherein said chlorine-based bleaching agent has a water solubility of at least 1 grams per 100 grams of water at 25° C.

8. A treatment article according to claim 1, wherein said chlorine-based bleaching agent has a mean particle size value of 250 microns to 500 microns.

9. A treatment article according to claim 1, wherein said chlorine-based bleaching agent has an initial mean particle size value greater than 250 microns and less than or equal to 1.5 times the average pore diameter of the diffusing membrane.

10. A treatment article according to claim 1, wherein said chlorine-based bleaching agent has an initial mean particle size value greater than 250 microns and less than or essentially equal to the average pore diameter of the diffusing membrane.

11. A treatment article according to claim 1, wherein said chlorine-based bleaching agent is selected from the group consisting of hydrated forms of said bleaching agents in a form having one or more molar equivalents of bound water.

12. A treatment article according to claim 1, wherein said chlorine-based bleaching agent is selected from the group consisting of sodium dichloroisocyanurate dihydrate, hydrated chlorinated trisodium phosphate, calcium hypochlorite dihydrate, dibasic calcium hypochlorite dihydrate, and combinations thereof.

13. A treatment article according to claim 1, wherein said powdered benefit agent comprises a carrier particle releasably containing the oxidant material, wherein said carrier particle has a mean particle size of at least 250 microns.

14. A treatment article according to claim 1, wherein said powdered benefit agent provides at least one primary fabric benefit to said fabric during a tumble drying process; wherein said primary fabric benefit is selected from a bleaching benefit, whitening benefit, stain removal benefit, odor removal benefit, mildew removal benefit, decontamination benefit, sanitization benefit, disinfection benefit, sterilization benefit, and/or combinations thereof.

15. A treatment article for treating a fabric during a tumble drying process to deliver at least one benefit agent to the fabric, said treatment article comprising:

(a) at least one pouch which dispenses at least one powdered benefit agent during the drying process, said pouch comprising:

i. a flexible hollow containment means comprising a diffusing membrane separating and totally surrounding an interior region from an outer exterior environment;

wherein said containment means has an interior volume capable of containing from between 1 to 100 grams of at least one powdered benefit agent;

wherein said diffusing membrane provides the only communication means for migration of the powdered benefit agent between the interior region and the outer exterior environment;

wherein said diffusing membrane comprises a porous water insoluble non-woven material having an average pore diameter of 250 microns to 1000 microns, and a thickness of less than 7.5 millimeters; wherein said non-woven material comprises a bleach stable polymer;

wherein the exterior facing side of said diffusing membrane is wholly surrounded by at least one barrier membrane;

(b) a powdered benefit agent comprising an oxidant material in the form of particles having a mean particle size of at least 250 microns; wherein said oxidant material comprises a chlorine-based bleaching agent; and wherein said powdered benefit agent particles are released from said pouch when the dryer temperature is in the range of from about 60° C. to about 100° C.;

(c) optionally, a second benefit agent comprising a secondary benefit material in the form of secondary particles having a mean secondary particle size of between 100 to 1000 microns; and (d) optionally, a third benefit agent comprising a third benefit material comprising a tertiary particle having an initial mean tertiary particle size value that is at least 2 times greater than the average pore diameter of the diffusing membrane; wherein said third benefit agent undergoes at least one of a phase change, a physical change and/or a chemical change when heated to a temperature above 60° C.; said tertiary benefit agent being capable of being released from said pouch through said diffusing membrane when in the form of a liquid, a gas, a vapor, a volatilized substance and/or combinations thereof.

16. A treatment article according to claim 15 wherein said barrier membrane is selected from the group consisting of a water degradable membrane or coating, a moisture degradable membrane or coating, a heat degradable membrane or coating, a friction degradable membrane or coating, a manually removable membrane or coating, and/or combinations thereof.

17. A treatment article for treating a fabric during a tumble drying process to deliver at least one benefit agent to the fabric, said treatment article comprising:

(a) at least one pouch which dispenses at least one powdered benefit agent during the drying process, said pouch comprising:

i. a flexible hollow containment means comprising a diffusing membrane separating and totally surrounding an interior region from an outer exterior environment;

wherein said containment means has an interior volume capable of containing from between 1 to 100 grams of at least one powdered benefit agent;

wherein said diffusing membrane provides the only communication means for migration of the powdered benefit agent between the interior region and the outer exterior environment;

wherein said diffusing membrane comprises a porous water insoluble non-woven material having an average pore diameter of 250 microns to 1000 microns, and a thickness of less than 7.5 millimeters;

wherein said non-woven material comprises a bleach stable polymer;

wherein said bleach stable polymer is selected from the group consisting of polyester, polypropylene, polyethylene, hydrophilically modified polyester, hydrophobically modified polyester, hydrophilically modified polypropylene, hydrophilically modified polyethylene and mixtures thereof;

(b) a powdered benefit agent comprising an oxidant material in the form of particles having a mean particle size of at least 250 microns; wherein said oxidant material comprises a chlorine-based bleaching agent; and wherein said powdered benefit agent particles are released from said pouch when the dryer temperature is in the range of from about 60° C. to about 100° C.;

(c) optionally, a second benefit agent comprising a secondary benefit material in the form of secondary particles having a mean secondary particle size of between 100 to 1000 microns; and (d) optionally, a third benefit agent comprising a third benefit material comprising a tertiary particle having an initial mean tertiary particle size value that is at least 2 times greater than the average pore diameter of the diffusing membrane; wherein said third benefit agent undergoes at least one of a phase change, a physical change and/or a chemical change when heated to a temperature above 60° C.; said tertiary benefit agent being capable of being released from said pouch through said diffusing membrane when in the form of a liquid, a gas, a vapor, a volatilized substance and/or combinations thereof.

18. A treatment article for treating a fabric during a tumble drying process to deliver at least one benefit agent to the fabric, said treatment article comprising:

(a) at least one pouch which dispenses at least one powdered benefit agent during the drying process, said pouch comprising:

i. a flexible hollow containment means comprising a diffusing membrane separating and totally surrounding an interior region from an outer exterior environment;

wherein said containment means has an interior volume capable of containing from between 1 to 100 grams of at least one powdered benefit agent;

wherein said diffusing membrane provides the only communication means for migration of the powdered benefit agent between the interior region and the outer exterior environment;

wherein said diffusing membrane comprises a porous water insoluble non-woven material having an average pore diameter of 250 microns to 1000 microns, and a thickness of less than 7.5 millimeters;

wherein said non-woven material comprises a bleach stable polymer;

(b) a powdered benefit agent comprising an oxidant material in the form of particles having a mean particle size of at least 250 microns; wherein said oxidant material comprises a chlorine-based bleaching agent; and wherein said powdered benefit agent particles are released from said pouch when the dryer temperature is in the range of from about 60° C. to about 100° C.;

wherein said chlorine-based bleaching agent has an initial mean particle size value greater than 250 microns and less than or equal to 2 times the average pore diameter of the diffusing membrane;

(c) optionally, a second benefit agent comprising a secondary benefit material in the form of secondary particles having a mean secondary particle size of between 100 to 1000 microns; and (d) optionally, a third benefit agent comprising a third benefit material comprising a tertiary particle having an initial mean tertiary particle size value that is at least 2 times greater than the average pore diameter of the diffusing membrane; wherein said third benefit agent undergoes at least one of a phase change, a physical change and/or a chemical change when heated to a temperature above 60° C.; said tertiary benefit agent being capable of being released from said pouch through said diffusing membrane when in the form of a liquid, a gas, a vapor, a volatilized substance and/or combinations thereof.

* * * * *